112-418 SH
10/15/85 XM 4,546,497

United States Patent [19]

Ono et al.

[11] Patent Number: 4,546,497

[45] Date of Patent: Oct. 15, 1985

[54] ANTISTATIC CLOTHING

[75] Inventors: Kazumasa Ono, Atsugi; Koichi Okoshi, Tokyo, both of Japan

[73] Assignee: Midori Anzen Industry Co., Ltd., Tokyo, Japan

[21] Appl. No.: 537,400

[22] PCT Filed: Apr. 14, 1983

[86] PCT No.: PCT/JP83/00114

§ 371 Date: Aug. 30, 1983

§ 102(e) Date: Aug. 30, 1983

[87] PCT Pub. No.: WO83/03526

PCT Pub. Date: Oct. 27, 1983

[30] Foreign Application Priority Data

Apr. 15, 1982 [JP] Japan ..... 57-53709[U]

[51] Int. Cl.[4] ..... A41D 27/24

[52] U.S. Cl. ..... 2/243 A; 2/275; 2/DIG. 7; 112/418; 139/420 R; 139/425 R

[58] Field of Search ..... 2/243 A, 243 R, 259, 2/260, 275, DIG. 7; 139/425 R, 420 R, 420 G; 112/417, 418, 420; 428/922, 285

[56] References Cited

U.S. PATENT DOCUMENTS

| | | | |
|---|---|---|---|
| 1,706,461 | 3/1929 | Oathout | 112/418 |
| 3,011,172 | 12/1961 | Tames | 2/DIG. 7 |
| 3,288,175 | 11/1966 | Valko | 139/425 R |
| 3,422,460 | 1/1969 | Burke et al. | 139/425 R |
| 3,986,530 | 10/1976 | Maekawa | 139/425 R |
| 4,319,361 | 3/1982 | Prince | 112/417 X |
| 4,422,483 | 12/1983 | Zins | 139/420 R |

FOREIGN PATENT DOCUMENTS

| | | | |
|---|---|---|---|
| 572811 | 10/1945 | United Kingdom | 139/425 R |

*Primary Examiner*—Werner H. Schroeder
*Assistant Examiner*—J. L. Kravitz
*Attorney, Agent, or Firm*—Koda and Androlia

[57] ABSTRACT

The invention provides antistatic clothing suitable for wear in a room which is kept clean. The clothing, such as working clothes, work shoes, etc., manufactured from a cloth having parallel electroconductive fibers woven therein, features the incorporation of an electroconductive material at overlapped or butt-joined seams between the pieces of cloth forming the clothing to ensure a perfect electrostatic connection of all the pieces of the clothing to minimize static charging on both the clothing and the wearer's body while preventing dust from gathering on the clothing to avoid dust from becoming a cause of problems such as electrostatic breakdown of circuit elements in a semiconductor integrated circuit production plant.

1 Claim, 9 Drawing Figures

ANTISTATIC CLOTHING

DESCRIPTION

1. Technical Field

This invention relates to antistatic clothing to be worn principally in a room which is kept clean (hereinafter referred to as a clean room).

2. Background Art

So-called dust-free clothes have been used as working dress, surgeon's operating gowns, etc., (hereinafter referred to generically as working clothes) worn in clean rooms in plants producing semi-conductor integrated circuits, or hospitals, etc. Especially in a clean room where an extremely clean area is required, a worker must wear clothes which can prevent minute fragments of skin or fine particles of dried skin secretions from being released from the seams or other parts of the clothes, and can also stop the loss of particles of material such as pieces of thread from the clothes.

Such working clothes can be manufactured from a cloth composed of long fibers of nylon, polyester or other dust-resistant material woven to a high density.

However, these working clothes, because of the high electrical insulation resistance of their texture, tend to give rise to static electricity and become statically charged.

Such a charged state not only attracts fine dust particles but also becomes a cause of problems, such as static breakdown of circuit elements produced in a semiconductor integrated circuit production plant, because a worker could become a charged body.

Working clothes that can remove this tendency in static charging have been manufactured by using a cloth made by weaving electroconductive fibers such as carbon or metal fibers parallel to each other at suitable intervals in the base cloth.

Such working clothes, however, have the following shortcomings. When two pieces of cloth 1 and 2 are stitched together along their overlapping edges as shown in FIG. 1, the electroconductive fibers 3, 4 in the respective pieces of cloth tend to go out of alignment with each other and thus it is difficult to stitch the pieces of cloth together so that the electroconductive fibers are aligned properly with each other to ensure perfect electric conduction. In fact, it is often found that the electroconductive fibers are not connected electrically to each other at the seams of the finished clothes. For these and other reasons, there are certain limitations to the possible extent of the reduction of static charge on both working clothes and the wearer's body.

The present invention has for its object the provision of antistatic clothing which is free from the problems of the prior art.

DISCLOSURE OF INVENTION

This invention features the incorporation of an electroconductive material in the overlapped seams or butt-joined seams of working clothes, work shoes and other clothing manufactured from a cloth having parallel electroconductive fibers woven therein. Such a provision of an electroconductive material ensures a perfect electrostatic connection at each of the seams of the clothing to minimize static charging on both the clothing and the wearer's body, thus providing an antistatic garment which is suited for wearing in a clean room.

Further, according to this invention, clothing such as working clothes, work shoes, etc., can be manufactured from a cloth using dust-resistant long fibers woven to a high density. This proves helpful in preventing dust and other contaminants in the clothing from being released therefrom, and thus there antistatic clothing is provided which is ideal to wear not only in an ordinary clean room but also in such a clean room where an extremely clean area is required.

BRIEF DESCRIPTION OF DRAWINGS

FIGS. 2 to 9 illustrate embodiments of the present invention, wherein FIG. 2 shows a method of seaming according to this invention, FIG. 3 shows a part joined by this method, FIG. 4 illustrates another method of seaming, FIG. 5 illustrates a third method of seaming, FIG. 6 shows an example of butt-joining, FIG. 7 illustrates a piece of cloth with both edges thereof seamed together, FIG. 8 shows part of a cylindrical cover to be stitched onto a work shoe, and FIG. 9 shows the cover in use.

BEST MODE FOR CARRYING OUT THE INVENTION

Figure 1:
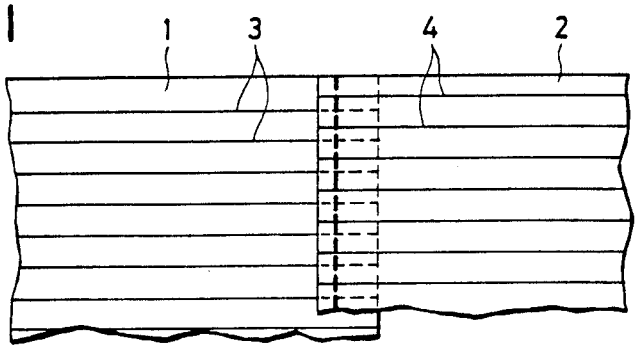
FIG. 1 is a drawing showing an overlapped seam in conventional clothing.
Figure 2:
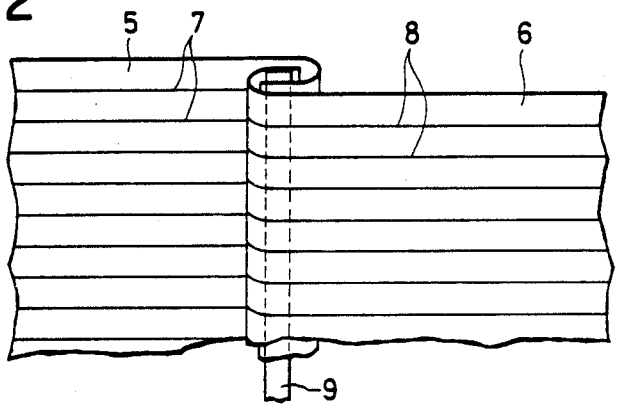
Figure 3:
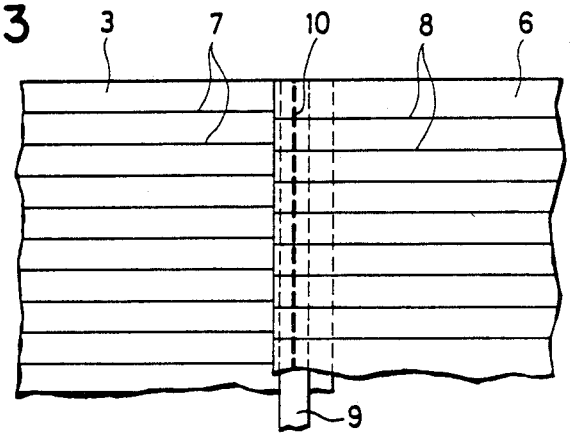

The invention will be described in more detail below in conjunction with the accompanying drawings. Numerals 5 and 6 in the drawings designate pieces of cloth cut as required for stitching up into clothing such as working clothes. These pieces of cloth were cut from a fabric comprising long fibers of a dust-resistant material such as nylon, polyester, etc., woven to a high density, and in which electroconductive fibers 7, 8 are woven parallel to each other at suitable intervals. The edges of these pieces of cloth are folded back and placed one over another as shown in FIG. 2, electroconductive tape 9 is sandwiched therebetween, and they are stitched together as shown in FIG. 3. In this way, the cut pieces of cloth are joined and sewn together at the corresponding edges with electroconductive tape placed within each of the thus joined seams to make the desired clothes such as working clothes.

Figure 4:
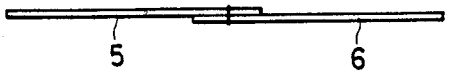
Figure 5:
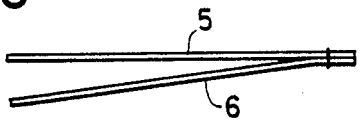
Figure 6:
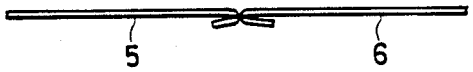

The embodiment of this invention described above only refer to the case in which the edges of two pieces of cloth 5 and 6 are folded back and seamed. It is also possible in this invention to employ other methods of seaming such as, for example, simply placing the edges of two pieces of cloth 5, 6 one over the other from opposite directions without folding back the edges, as shown in FIG. 4, or placing the edges in the same direction as shown in FIG. 5. The folded-back edges of the two pieces of cloth 5, 6 can also be butted against each other and then seamed as shown in FIG. 6.

In the above-described embodiments, overlapping edges of pieces of cloth are joined by stitching with electroconductive tape held therebetween, but it is possible within the scope of this invention to employ other means of joining which are capable of securing superimposed edge portions unseparably. For example, an electroconductive coating material can be applied to one or both of superimposed edge portions and then these portions can be stitched together, or superimposed portions with electroconductive tape held therebetween may be fused integrally by heating or other means such as applying a solvent to provide a seamless join.

Figure 7:
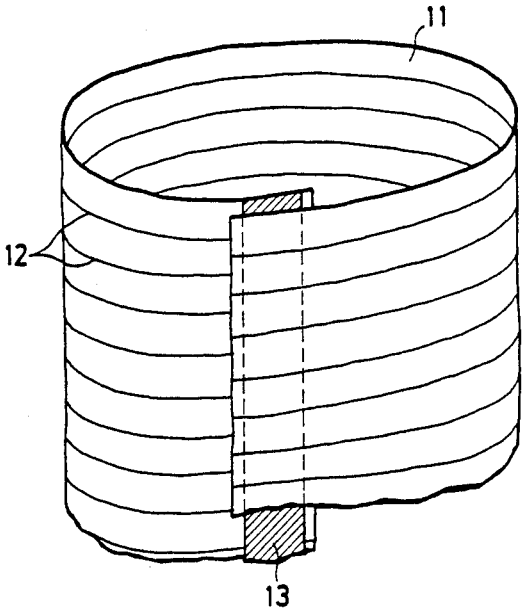

Further, not only two layers of pieces of cloth can be joined as in the foregoing embodiments, but also three or more layers. Also, as shown in FIG. 7, a single piece of cloth may be made into a cylinder and its two edges can be superimposed as required one over the other with electroconductive tape 13 or other electroconductive material disposed therein for the electric connection of the electroconductive fibers 12, and then joined by stitching or other suitable means.

Figure 8:
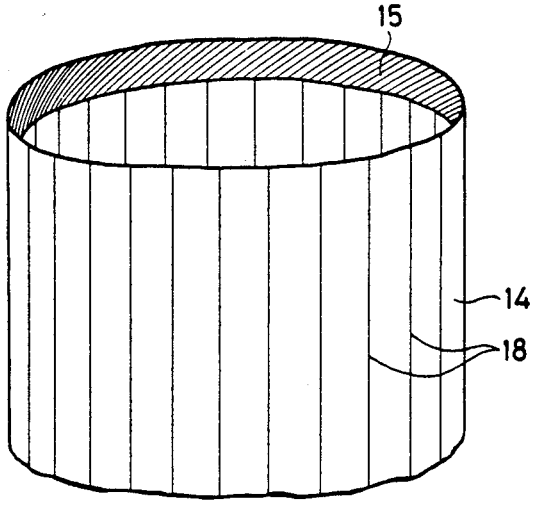
Figure 9:
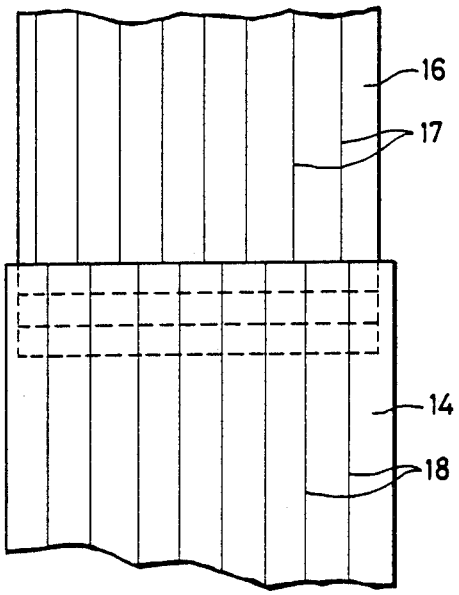

The present invention can be adapted not only to various sorts of clothing such as upper garments, trousers, combinations thereof, coats, etc., but may be also embodied as an attachment to such clothing. That is, as shown in FIG. 8, a collar-like cylindrical cover 14 stitched to the opening of a work shoe, especially a static shoe (not shown), so as to cover the cuff or hem of a trouser leg can be made from the same cloth as that used in the above embodiments, with electroconductive tape 15 or other electroconductive material provided along the inner top edge of the cover 14, so that when in use the upper part of the cylindrical cover 15 is placed over the cuff of the trouser leg 16 so that it attaches thereto, and the electroconductive fibers 17 woven into the trouser leg 16 and the corresponding electroconductive fibers 18 in the cylindrical cover 14 come into electrical contact with each other through the electroconductive tape 15. A similar attachment method may be adapted to other separably contacting parts such as the overlapping parts of an upper garment and trousers when worn.

Industrial Applicability

The present invention incorporates an electroconductive material in superimposed or butt-joined seams of clothing such as working clothes, work shoes, etc., manufactured from a cloth with electroconductive fibers woven in parallel to each other as described above. Adaptation of this invention, therefore, enables a perfect electrostatic connection at the seams of clothing. The invention can be applied in conjunction with static shoes, static floors, etc., to be used in a clean room, or it may be adapted independently in clothing to control static charging on both the clothing and the wearer's body to a minimum level. It is therefore possible with this invention to prevent dust from gathering on working clothes, etc., to become a cause of problems such as static breakdown of circuit elements in a semiconductor integrated circuit production plant. Further, by the use of a cloth made by densely weaving long fibers of dust-resistant nylon, polyester or the like, minute fragments of human skin or fine particles of dried skin secretions are held within the clothing to prevent the release of dust to the outside. Thus the clothing provided according to this invention is suitable for wear not only in an ordinary clean room but also in such a clean room where an extremely clean area must be maintained.

What is claimed is:

1. A butt-joined seam for antistatic cloth composed of long dust-resistant fibers woven to a high density with parallel electroconductive fibers which do not cross one another woven therein, characterized in that an electroconductive material selected from the group consisting of electroconductive tape, conductive paint and conductive coatings, is disposed at overlaps between pieces of antistatic cloth forming said butt-joined seam.

* * * * *